US007970315B2

(12) United States Patent
Sato

(10) Patent No.: US 7,970,315 B2
(45) Date of Patent: Jun. 28, 2011

(54) DEVELOPING CARTRIDGE HAVING GEAR SUPPORT

(75) Inventor: Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/877,522

(22) Filed: Sep. 8, 2010

(65) Prior Publication Data

US 2010/0329736 A1 Dec. 30, 2010

Related U.S. Application Data

(63) Continuation of application No. 12/340,870, filed on Dec. 22, 2008, now Pat. No. 7,813,673.

(30) Foreign Application Priority Data

Dec. 28, 2007 (JP) ..... 2007-340753

(51) Int. Cl.
*G03G 15/08* (2006.01)

(52) U.S. Cl. ..... 399/119; 399/222

(58) Field of Classification Search ..... 399/107, 399/111, 119, 222, 252, 265, 267, 272, 279, 399/281

See application file for complete search history.

(56) References Cited

U.S. PATENT DOCUMENTS

| | | | | |
|---|---|---|---|---|
| 5,950,048 | A * | 9/1999 | Okumura et al. | 399/113 |
| 6,823,160 | B2 | 11/2004 | Okabe | |
| 7,076,190 | B2 | 7/2006 | Jeon | |
| 7,162,183 | B2 | 1/2007 | Jeon | |
| 7,327,970 | B2 | 2/2008 | Moon | |
| 7,430,387 | B2 | 9/2008 | Kim et al. | |
| 7,463,834 | B2 | 12/2008 | Takagi et al. | |
| 7,536,117 | B2 | 5/2009 | Kishi | |
| 7,672,611 | B2 | 3/2010 | Nakaya | |
| 2003/0185594 | A1 | 10/2003 | Okabe | |
| 2005/0002684 | A1 | 1/2005 | Suzuki | |
| 2005/0013627 | A1 | 1/2005 | Jeon | |
| 2007/0122176 | A1 | 5/2007 | Sato | |
| 2007/0122188 | A1 * | 5/2007 | Igarashi | 399/119 |

FOREIGN PATENT DOCUMENTS

| | | | |
|---|---|---|---|
| JP | 07-181797 | A | 7/1995 |
| JP | 2001-134073 | A | 5/2001 |
| JP | 2003-295614 | A | 10/2003 |
| JP | 2005-024811 | A | 1/2005 |
| JP | 2005-037889 | A | 2/2005 |
| JP | 2007-148287 | A | 6/2007 |

OTHER PUBLICATIONS

Extended EP Search Report dtd Apr. 14, 2009, EP Appln. 08022068.4.

JP Office Action dtd Dec. 10, 2009, JP Appln. 2007-340753, partial English Translation.

Notification of Reason for Refusal dispatched Oct. 26, 2010 in Japanese Application No. 2010-094564 and English translation thereof.

* cited by examiner

*Primary Examiner* — Robert Beatty

(74) *Attorney, Agent, or Firm* — Banner & Witcoff, Ltd.

(57) ABSTRACT

A developing cartridge is provided. The developing cartridge includes an input gear which receives an external driving force; a developing roller which carries developer; a supply roller that is in contact with the developing roller and supplies the developer to the developing roller; a supply roller gear that is meshed with the input gear to drive the supply roller using a driving force transmitted from the input gear; and a developing roller gear that drives the developing roller with a driving force transmitted from the supply roller gear.

8 Claims, 3 Drawing Sheets

UPPER SIDE
RIGHT SIDE
FRONT SIDE
BACK SIDE
LEFT SIDE
LOWER SIDE 17
30
38
46
47
48
40
55
41
57
43
6
42
52
54
36 (35)
53
G
F
A
X
B
15
E
D
45
C
44
51
Z
Y
50 (59)
15
56
58
49
50
59

DEVELOPING CARTRIDGE HAVING GEAR SUPPORT

CROSS-REFERENCE TO RELATED APPLICATIONS

This application is a continuation of prior U.S. application Ser. No. 12/340,870, filed Dec. 22, 2008, which claims priority from Japanese Patent Application No. 2007-340753 filed on Dec. 28, 2007, the entire subject matter of which is incorporated herein by reference.

TECHNICAL FIELD

Aspects of the invention relate to a developing cartridge mounted on an image forming apparatus.

BACKGROUND

For example, JP-A-2003-295614 describes a related art developing cartridge that has a toner hopper for filling toner, and a supply roller and a developing roller disposed sideways of the toner hopper. The supply roller and the developing roller are mutually welded, a nip being formed between them. The toner of the toner hopper is supplied to the supply roller, then supplied to the developing roller at the nip and carried on the surface of the developing roller. The toner carried on the surface of the developing roller is supplied to an electrostatic latent image formed on a photosensitive drum to visualize the electrostatic latent image.

In the related art developing cartridge, the developing roller has a developing roller drive gear, and the supply roller has a supply roller drive gear. The developing cartridge has an input gear which is coupled by a coupling member a motor of the electro-photographic image forming apparatus, and thus a motive power is transmitted from the external motor to input gear through the coupling member. Both the developing roller drive gear and the supply roller drive gear are meshed with the input gear. A driving force from the motor is input to the input gear from the coupling member, and transmitted from the input gear to both the developing roller drive gear and the supply roller drive gear at the same time. Thereby, the developing roller and the supply roller are rotated and driven simultaneously.

In the related art developing cartridge, when a new developing cartridge is used, there is no toner at the nip between the supply roller and the developing roller. Accordingly, since there is no toner to reduce a frictional force at the nip between the supply roller and the developing roller, a higher load is applied to the supply roller that is about to start rotating than during normal rotation (i.e., a state in which the toner exists at the nip).

Since the toner of the toner hopper drifts from the supply roller to the developing roller, it could be advantageous if the supply roller could start rotating before the developing roller in consideration of a backlash between the input gear and the supply roller drive gear.

However, in the related art developer cartridge, it is difficult for the supply roller to start rotating before the developing roller, because in the related art configuration both the developing roller drive gear and the supply roller drive gear are meshed with the input gear. A driving force inputted from the coupling member into the input gear is subdivided into forces applied to the developing roller drive gear and the supply roller drive gear, and the subdivided smaller driving force is transmitted to the supply roller drive gear. Therefore, there is an insufficient driving force transmitted to the supply roller to which the higher load is applied at a time at which the supply roller starts to rotate. This makes it more difficult for the supply roller to start rotating before the developing roller.

SUMMARY

Illustrative aspects of the invention provide a developing cartridge in which the supply roller can start rotating before the developing roller.

According to a first illustrative aspect of the invention, there is provided a developing cartridge comprising an input gear which receives an external driving force; a developing roller which carries developer; a supply roller that is in contact with the developing roller and supplies the developer to the developing roller; a supply roller gear that is meshed with the input gear to drive the supply roller using a driving force transmitted from the input gear; and a developing roller gear that drives the developing roller with a driving force transmitted from the supply roller gear.

According to a second illustrative aspect of the invention, there is provide a developing cartridge comprising a housing comprising a partition wall which partitions an inside of the housing into a first chamber which accommodates a developer, and a second chamber, the partition wall being located centrally within the developing cartridge; a developing roller which carries developer and which is provided in the second chamber of the housing; a supply roller that is in contact with the developing roller and supplies the developer to the developing roller, the supply roller also being provided in the second chamber of the housing; an input gear which is attached to a first cylindrical boss provided on an outside of the housing and positioned such that the input gear and the partition wall overlap; a supply roller gear that is attached to a shaft of the supply roller, the supply roller gear being directly meshed with the input gear to receive a driving force transmitted from the input gear; an idle gear that is attached to a second cylindrical boss provided on the outside of the housing, the idle gear being meshed with the supply roller gear; a developing roller gear that is attached to a shaft of the developer roller and is meshed only to the idle gear to receive a driving force transmitted from the supply roller gear through the idle gear; and a reinforcing portion comprising a thin rectangular plate, a pawl which is attached to the housing, and a through hole which is provided in the thin rectangular plate and to which the shaft of the supply roller is rotatably attached, wherein adjacent corners of the thin rectangular plate are notched to mate with the first cylindrical boss and the second cylindrical boss, and an opposite side of the thin rectangular plate from the first and second cylindrical bosses is notched to accommodate the pawl, in order to stabilize the supply roller while the supply roller is driven by the input gear.

DETAILED DESCRIPTION

I. Exemplary Embodiments

Exemplary embodiments of the invention will now be described with reference to the drawings.

(Image Forming Apparatus)

Figure 1:
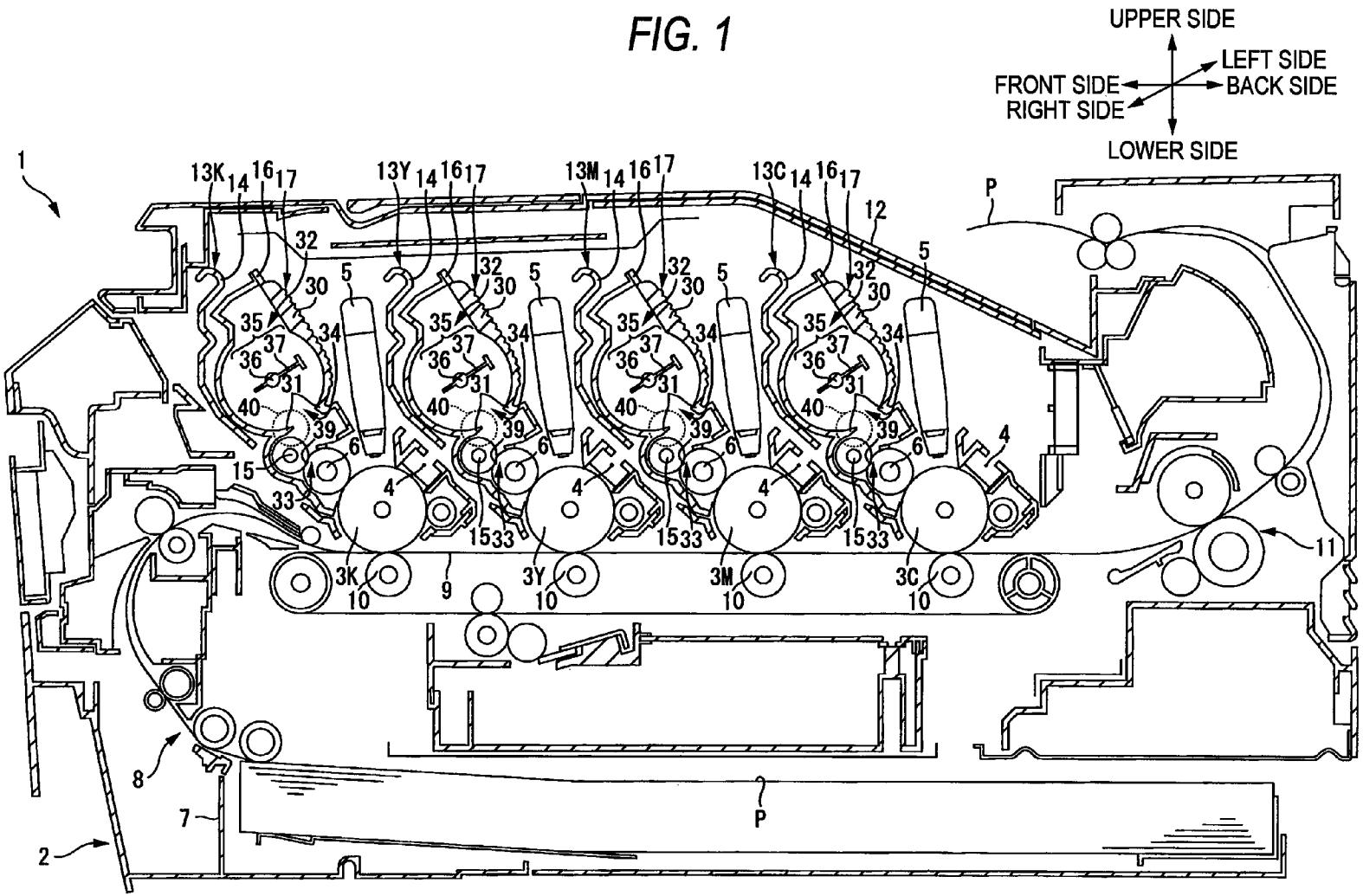
FIG. 1 is a cross-sectional side view showing an image forming apparatus according to an exemplary embodiment of the invention.

FIG. 1 is a cross-sectional side view showing an image forming apparatus according to an exemplary embodiment of the invention. The direction as used herein is with reference to the direction of the arrow as indicated in the figure (same for other figures). Herein, the right-left direction and the width direction are equivalent.

A color printer is one example of the image forming apparatus 1. Four photosensitive drums 3 are disposed in parallel along the front-back direction within a body casing 2 of the image forming apparatus 1, as shown in FIG. 1. In the following, the four photosensitive drums 3 are distinguished as a photosensitive drum 3K (black), a photosensitive drum 3C (cyan), a photosensitive drum 3M (magenta) and a photosensitive drum 3Y (yellow) corresponding to the four colors (e.g., black, cyan, magenta and yellow) of developer images (hereinafter described) formed on the photosensitive drums 3. Each photosensitive drum 3 has a scorotron-type charger 4, a light emitting diode (LED) unit 5 and a developing roller 6 that are disposed adjacent to the photosensitive drum 3.

The surface of the photosensitive drum 3 is uniformly charged by the scorotron-type charger 4, and then exposed by an LED (not shown) provided in the LED unit 5. Thereby, an electrostatic latent image based on image data is formed on the surface of each photosensitive drum 3. Each electrostatic latent image is visualized by developer carried on the developing roller 6 corresponding to each photosensitive drum 3 to form a developer image on the surface of the photosensitive drum 3.

A sheet P is stored in a sheet feed cassette 7 within the body casing 2. The sheet P is fed from the sheet feed cassette 7, and a conveying direction of the sheet P is thereafter changed from the front to the back through various kinds of rollers provided in a feeder unit 8 and conveyed onto a conveying belt 9. The conveying belt 9 is disposed between each photosensitive drum 3K, 3C, 3M and 3Y and a transfer roller 10 opposed to each photosensitive drum 3. The developer image on the surface of each photosensitive drum 3 is transferred onto the sheet P conveyed on the conveying belt 9 due to a transfer bias applied to the transfer roller 10, and superimposed successively.

The sheet P onto which the developer images of four colors are transferred is conveyed to a fixing part 11. The developer images transferred onto the sheet P are thermally fixed in the fixing part 11. Thereafter, a conveying direction of the sheet P is changed from the back to the front through various kinds of rollers and discharged onto a sheet discharge tray 12.

Herein, the image forming apparatus 1 has four process cartridges 13 corresponding to four colors. In the following, the four process cartridges 13 are distinguished as a process cartridge 13K (black), a process cartridge 13C (cyan), a process cartridge 13M (magenta) and a process cartridge 13Y (yellow), corresponding to the four colors.

Each process cartridge 13 is removably mounted within the body casing 2, and disposed in parallel along the front-back direction.

The corresponding photosensitive drum 3, the scorotron-type charger 4, the developing roller 6, a supply roller 15 and a toner hopper 16 are mainly disposed within a casing (process casing 14) of each process cartridge 13. Each central axis (rotation axis) of the photosensitive drum 3, the developing roller 6 and the supply roller 15 extends along the width direction. In each process cartridge 13, the developer accommodated within the toner hopper 16 is supplied to the developing roller 6 by the supply roller 15, and carried on the developing roller 6, as described above.

(Developing Cartridge)

The developing roller 6, the supply roller 15 and the toner hopper 16 are configured as a unit, and can be mounted or dismounted as a developing cartridge 17 on or from the process cartridge 14.

The developing cartridge 17 comprises a developing casing 30 as one example of a housing. The developing casing 30 has a box shape extending long in the width direction. In a state where the developing cartridge 17 is mounted on the process cartridge 14, the developing casing 30 is inclined to be directed obliquely upward to the front in right side view of FIG. 1.

A partition wall 31 extending in the width direction is provided halfway in the up-down direction inside the developing casing 30. The inside of the developing casing 30 is partitioned into a first chamber 32 and a second chamber 33 by the partition wall 31. The first chamber 32 is above the second chamber 33. The partition wall 31 is formed with a communication hole 34, whereby the first chamber 32 and the second chamber 33 are in communication with each other via the communication hole 34.

The first chamber 32 corresponds to the inside of the toner hopper 16, and accommodates the developer. An agitator 35 is disposed within the first chamber 32. The agitator 35 comprises a shaft extending along the axial direction, and a vane 37 attached to the shaft 36. If the vane 37 is rotated around the shaft 36 in the agitator 35, the developer in the first chamber 32 is agitated by the vane 37, and discharged through the communication hole 34 into the second chamber 33.

The second chamber 33 houses the developing roller 6 and the supply roller 15. The supply roller 15 is disposed adjacent to the communication hole 34. The developing roller 6 is disposed on the back side (more particularly obliquely downward to the back) of the supply roller 15. A portion of the outer circumferential surface of the developing roller 6, obliquely upward to the front, is welded with a portion of the outer circumferential surface of the supply roller 15, with a nip 39 formed between the developing roller 6 and the supply roller 15. The outer circumferential surface of the developing roller 6, obliquely downward to the back, is exposed from the lower part of the developing casing 30 to contact the photosensitive drum 3. The developer discharged through the communication hole 34 into the second chamber 33 is supplied to the supply roller 15 and from the supply roller 15 via the nip 39 to the developing roller 6 to visualize the electrostatic latent image on the photosensitive drum 3.

Figures 2A, 2B, 2C:
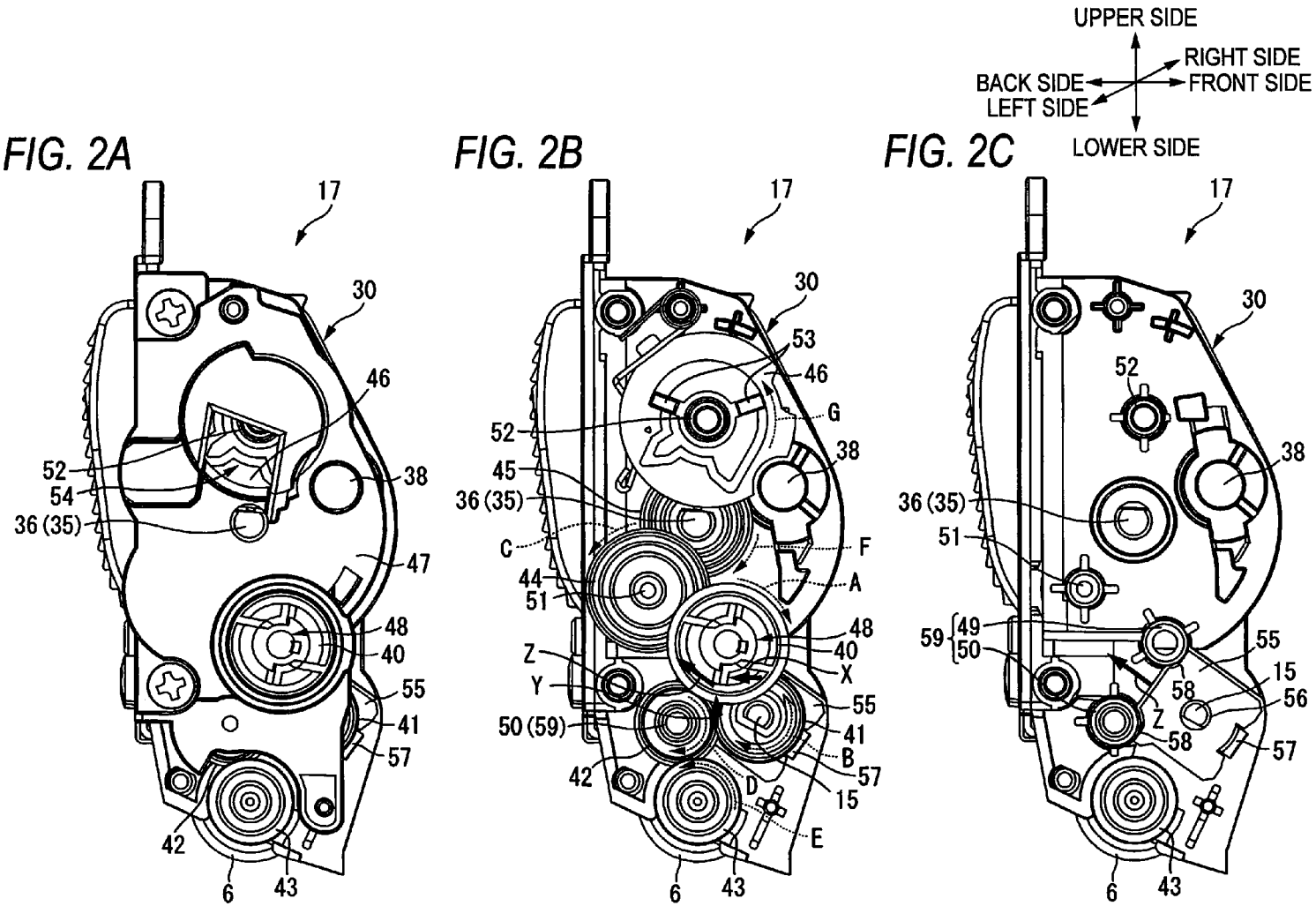
FIG. 2A is a left side view of a developing cartridge according to an exemplary embodiment of the invention.
FIG. 2B is a view showing a state in which a gear cover is removed to show an arrangement of gears of the developing cartridge of FIG. 2A.
FIG. 2C is a view showing a state in which the gears are removed from FIG. 2B.
Figure 3:
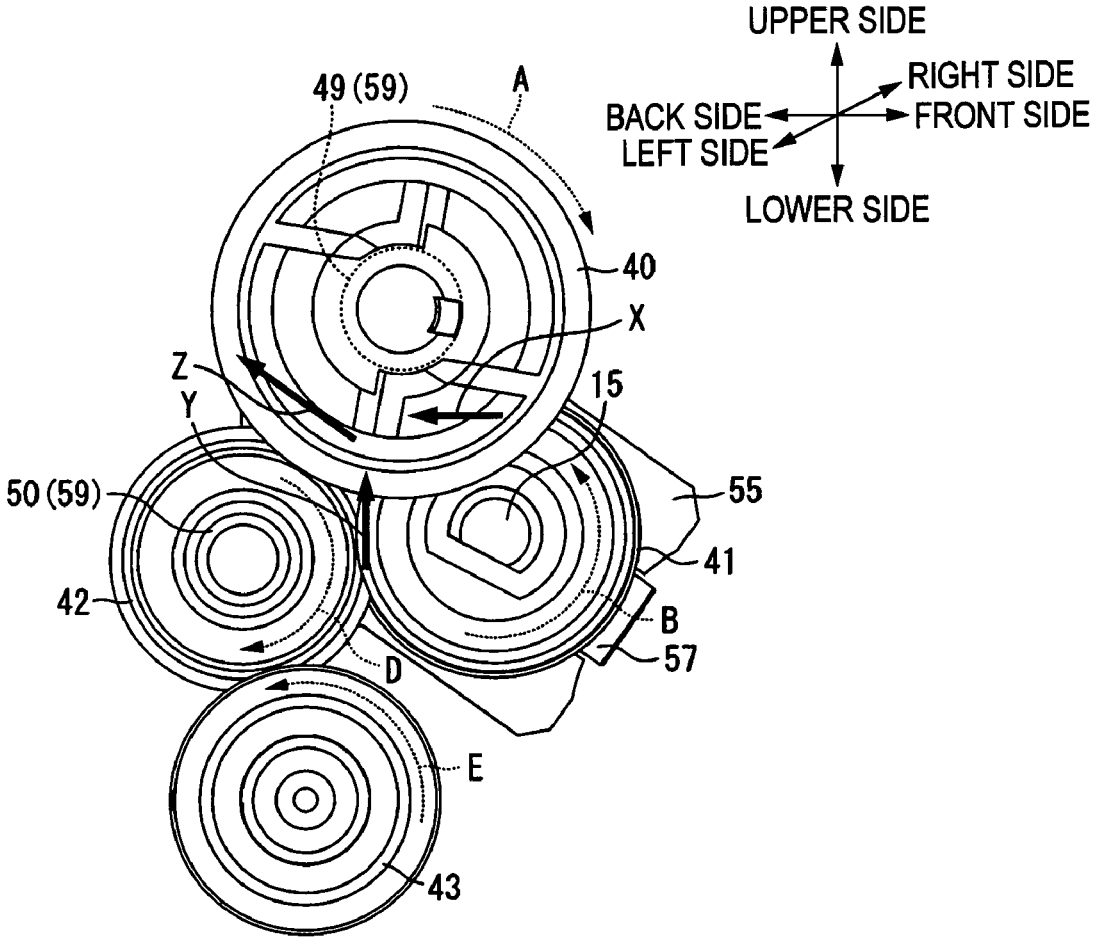
FIG. 3 is an enlarged view of the gears of FIG. 2B.

FIG. 2A is a left side view of the developing cartridge according to an exemplary embodiment of the invention, FIG. 2B is a view showing the developing cartridge of FIG. 2A in a state in which a gear cover is removed from the developing cartridge in order to show the gears, and FIG. 2C is a view of the developing cartridge showing a state in which the gears are removed from FIG. 2B. FIG. 3 is an enlarged view of the gears shown in FIG. 2B. For convenience of explanation, the developing cartridge 17 (developing casing 30) is shown in an up-down direction in FIGS. 2A-2C.

The input gear 40, the supply roller gear 41, the first idle gear 42, the developing roller gear 43, a second idle gear 44, an agitator gear 45 and a detection gear 46 are provided on, for example, the left side surface of the developing casing 30, as shown in FIG. 2B. These gears have a columnar shape with a central axis (i.e., a rotation axis) extending along the width direction, and are protected by a gear cover 47 (see FIG. 2A). A window 38 is provided at a position corresponding to the first chamber 32 (see FIG. 1) on the left side surface of the developing casing 30. The gear cover 47 corresponding to the window 38 is formed with a hole (see FIG. 2A). The amount of developer accommodated within the first chamber 32 can be determined via the window 38.

In the input gear 40, a right portion (i.e., a portion near the left side surface of the developing casing 30) has a one level smaller diameter than the left portion, with the gear teeth formed on the outer circumferential surface of the right portion. A concave portion 48 is recessed to the right and is formed at a central position on the left end surface of the input gear 40 in left side view. The concave portion 48 is exposed to the left from the gear cover 47 (see FIG. 2A).

The input gear 40 is disposed centrally in the up-down direction of the developing casing 30, such that a position of the input gear 40 and a position of the partition wall 31 overlap each other when projected along the width direction (see FIG. 1). In other words, the position of the input gear 40 and the position of the partition wall 31 overlap each other as viewed from a side of the developing cartridge. An input gear shaft 49 is provided at a position coincident with the center of a circle of the input gear 40 on the left side surface of the developing casing 30 (see FIG. 2C). The input gear shaft 49 is a cylindrical boss that projects to the left from the developing casing 30. The input gear shaft 49 is inserted through the central part of the input gear 40 to support the input gear 40. Thereby, the input gear 40 can be rotated around the input gear shaft 49.

The supply roller gear 41 is formed with gear teeth on the outer circumferential surface of the supply roller gear 41. The supply roller gear 41 is disposed under the input gear 40 (more particularly obliquely downward to the front), and is mostly covered on the left side by the gear cover 47 except for a front end portion (see FIG. 2A). The upper part of the gear teeth of the supply roller gear 41 is meshed with the lower part of the gear teeth of the input gear 40. Also, a left end portion of the supply roller 15 (more particularly the shaft of the supply roller 15) is exposed at a position coincident with the center of the supply roller gear 41 on the left side surface of the developing casing 30 (see FIG. 2C). The left end portion of the supply roller 15 is inserted through the central part of the supply roller gear 41 to support the supply roller gear 41. Herein, the left section at the left end portion of the supply roller 15 has a D-character shape, and the part of the supply roller gear 41 through which the left end portion of the supply roller 15 is inserted is a hole of a similar D-character shape. Therefore, the supply roller gear 41 is rotated together with the supply roller 15.

The first idle gear 42 is formed with gear teeth on the outer circumferential surface thereof. The first idle gear 42 is disposed on the back side of the supply roller gear 41, and is covered from the left side by the gear cover 47 except for a lower end portion (see FIG. 2A). The front part of the gear teeth of the first idle gear 42 is meshed with the back part of the gear teeth of the supply roller gear 41. Also, a first idle gear shaft 50 as one example of an idle gear shaft is provided at a position coincident with the center of the first idle gear 42 on the left side surface of the developing casing 30 (see FIG. 2C). The first idle gear shaft 50 is a cylindrical boss projecting to the left from the developing casing 30, and is inserted through the central part of the first idle gear 42 to support the first idle gear 42. Thereby, the first idle gear 42 can be freely rotated around the first idle gear shaft 50.

A reinforcing plate 55 for the supply roller 15 is provided in the developing casing 30, as shown in FIG. 2C. The reinforcing plate 55 is a thin plate, almost rectangular in left side view, with a through hole 56 formed substantially in the center. A left end portion of the supply roller 15 (more particularly the shaft of the supply roller 15) exposed from the left side surface of the developing casing 30 is inserted into the through hole 56. Thereby, the supply roller 15 is borne by the reinforcing plate 55. The reinforcing plate 55 is engaged by a pawl 57 formed on the left side surface of the developing casing 30, and fixed to the left side surface of the developing casing 30. Also, the reinforcing plate 55 is formed with recesses 58 at two adjoining corners on the back side of the reinforcing plate 55, as shown in FIG. 2C. The input gear shaft 49 contacts the reinforcing plate 55 at the deepest part of one (upper) recess 58, and the first idle gear shaft 50 contacts the reinforcing plate 55 at the deepest part of the other (lower) recess 58. In the following, the input gear shaft 49 and the first idle gear shaft 50 may be collectively referred to as a contact part 59.

The developing roller gear 43 is formed with gear teeth on the outer circumferential surface thereof. The developing roller gear 43 is disposed under the first idle gear 42, and exposed to the left under the gear cover 47 (see FIG. 2A). The upper part of the gear teeth of the developing roller gear 43 is meshed with the lower part of the gear teeth of the first idle gear 42 as shown in FIG. 2B. Also, a left end portion of the developing roller 6 (more particularly the shaft of the developing roller 6) is exposed at a position coincident with the center of the developing roller gear 43 on the left side surface of the developing casing 30. (see FIG. 2C). The left end portion of the developing roller 6 is inserted through the central part of the developing roller gear 43 to support the developing roller gear 43. The developing roller gear 43 is attached to the left end portion of the developing roller 6 and is rotated together with the developing roller 6.

The right portion (portion near the left side surface of the developing casing 30) of the second idle gear 44 has a one level smaller diameter than the left portion, with the gear teeth formed on the outer circumferential surface of each of the right and left portions. The second idle gear 44 is disposed on the back side of the input gear 40 (more particularly obliquely upward to the back), and covered from the left side by the gear cover 47 (see FIG. 2A). The front part of the gear teeth on the left part of the second idle gear 44 is meshed with the back part of the gear teeth of the input gear 40. Also, a second idle gear shaft 51 is provided at a position coincident with the center of the second idle gear 44 on the left side surface of the developing casing 30 (see FIG. 2C). The second idle gear shaft 51 is a cylindrical boss projecting to the left from the developing casing 30, and is inserted through the central part of the second idle gear 44 to support the second idle gear 44. Thereby, the second idle gear 44 can be freely rotated around the second idle gear shaft 51.

The agitator gear 45 is formed with gear teeth on the outer circumferential surface thereof. The agitator gear 45 is disposed upward (more particularly obliquely upward to the front) of the second idle gear 44, and covered from the left side by the gear cover 47 (see FIG. 2A). The lower part of the gear teeth of the agitator gear 45 is meshed with the upper part of the gear teeth on the right part of the second idle gear 44. Also, a left end portion of the shaft 36 of the agitator 35 is exposed and is provided at a position coincident with the center of the agitator gear 45 on the left side surface of the developing casing 30 (see FIG. 2C). The left end portion of this shaft 36 is inserted through the central part of the agitator gear 45 to support the agitator gear 45. Herein, the left section at the left end portion of the shaft 36 has a D-character shape, and the part of the agitator gear 45 through which the left end portion of the shaft 36 is inserted is a hole of a similar D-character shape. Therefore, the agitator gear 45 is rotated together with the shaft 36. A left end surface of the shaft 36 is exposed to the left from the gear cover 47 (see FIG. 2A).

The detection gear 46 is formed as a gear with missing teeth and is formed with gear teeth partially covering the outer circumferential surface at the right end portion thereof. The detection gear 46 is disposed above the agitator gear 45. Also, a detection gear shaft 52 is provided at a position coincident with the center of the detection gear 46 on the left side surface of the developing casing 30 (see FIG. 2C). The detection gear shaft 52 is a cylindrical boss projecting to the left from the developing casing 30, and inserted through the central part of the detection gear 46 to support the detection gear 46. Thereby, the detection gear 46 can be freely rotated around the detection gear shaft 52. When the developing cartridge 17 is new (i.e., initially mounted on the process casing 14), the gear teeth of the detection gear 46 are meshed with the upper part of the gear teeth of the agitator gear 45.

A plurality of detected projections 53 projecting to the left are provided along the edge of the detection gear 46 on the left end surface of the detection gear 46. The detected projections 53 are provided to correspond to information on the developing cartridge 17, that is, information as to whether the developing cartridge 17 is new or old, or information on a number of printable sheets for the developing cartridge 17. The gear cover 47 is formed with an exposure hole 54 (see FIG. 2A), whereby if the detection gear 46 is rotated, the detected projections 53 are exposed to the left such that the detected projections 53 may be viewed through the exposure hole 54.

In a state in which the developing cartridge 17 is mounted on the process cartridge 14 (see FIG. 1), an output gear (not shown) provided in the body casing 2 of the image forming apparatus 1 is engaged with the concave portion 48 of the input gear 40. The output gear (not shown) is engaged with an output shaft of a motor (not shown) provided in the body casing 2.

When the motor operates, the output gear is rotated, and a driving force from the motor is transferred to the output gear, and transferred from the output gear (outside the developing cartridge 17) into the input gear 40 via the connection part of the output gear and the concave portion 48 of the input gear 40. Thereby, the input gear 40 is rotated clockwise in left side view (in the direction as indicated by the arrow A of the dotted line in the figure) (see FIG. 3).

The driving force from the input gear 40 is transmitted to each of the supply roller gear 41 meshed with the input gear 40 and the second idle gear 44. Thereby, the supply roller gear 41 is rotated counterclockwise in the left side view (in the direction as indicate by the arrow B of the dotted line in the figure) (see FIG. 3). Accordingly, the supply roller 15 is rotated together with the supply roller gear 41. That is, the supply roller gear 41 drives the supply roller 15. At this time, the tooth flank of the input gear 40 presses the tooth flank of the supply roller gear 41 at the mesh position between the input gear 40 and the supply roller gear 41. This pressing force (i.e., the pressing force of the tooth flank of the input gear 40 on the tooth flank of the supply roller gear 41) is defined as the pressing force X (see the arrow of the heavy line in FIG. 2B and FIG. 3). The action direction of the pressing force X is backward roughly along the direction of the arrow B at the mesh position between the input gear 40 and the supply roller gear 41. The second idle gear 44, like the supply roller gear 41, is rotated counterclockwise in left side view (i.e., in the direction as indicated by the arrow C of the dotted line in the figure).

A driving force from the supply roller gear 41 is transmitted to the first idle gear 42 meshed with the supply roller gear 41. Thereby, the first idle gear 42 is rotated clockwise in left side view (i.e., in the direction as indicated by the arrow D of the dotted line in the figure) (see FIG. 3). At this time, the tooth flank of the supply roller gear 41 presses the tooth flank of the first idle gear 42 at the mesh position between the first idle gear 42 and the supply roller gear 41. Herein, a reaction force against the pressing force of the tooth flank of the supply roller gear 41 on the tooth flank of the first idle gear 42 acts on the tooth flank of the supply roller gear 41. In other words, the tooth flank of the first idle gear 42 presses back against the tooth flank of the supply roller gear 41. This reaction pressing force is defined as the pressing force Y (see the arrow of the heavy line in FIG. 2B and FIG. 3). The action direction of the reaction pressing force Y is upward roughly along the opposite direction of the arrow D at the mesh position between the first idle gear 42 and the supply roller gear 41. The action direction of a resultant force Z of the pressing forces X and Y is obliquely upward to the back between the input gear shaft 49 and the first supply gear 50 (see the arrow of the heavy line in FIGS. 2B and 2C and FIG. 3). This resultant force Z acts on the supply roller gear 41, the left end portion of the supply roller 15 that supports the supply roller gear 41, and the reinforcing plate 55 that bears the left end portion of the supply roller 15. The above-mentioned contact part 59 (i.e., the input gear shaft 49 and the first idle gear shaft 50) contacts the reinforcing plate 55 from the downstream side (obliquely upward to the back) in the action direction of the resultant force Z in the corresponding recess 58 (see FIG. 2C).

Since the first idle gear 42 is meshed with the supply roller gear 41 and the developing roller gear 43, a driving force from the supply roller gear 41 is transmitted to the developing roller gear 43 by the first idle gear 42. Thereby, the developing roller gear 43 is rotated counterclockwise in left side view (in the direction as indicated by the arrow E of the dotted line in the figure see FIG. 3). Accordingly, the developing roller 6 is rotated together with the developing roller gear 43. That is, the developing roller gear 43 drives the developing roller 6.

Along with the rotation of the second idle gear 44, a driving force from the second idle gear 44 is transmitted to the agitator gear 45 meshed with the second idle gear 44. Thereby, the agitator gear 45 is rotated clockwise in left side view (i.e., in the direction as indicated by the arrow F of the dotted line in the figure). Accordingly, the agitator 35 is rotated.

A driving force from the agitator gear 45 is transmitted to the detection gear 46 meshed with the agitator gear 45. Thereby, the detection gear 46 is rotated counterclockwise in left side view (i.e., in the direction as indicated by the arrow G of the dotted line in the figure). Along with the rotation of the detection gear 46, the detected projections 53 are exposed through the exposure hole 54 (see FIG. 2A) of the gear cover 47, and detected by a sensor (not shown)) of the body casing 2. The detection result of the sensor is, for example, a number of the detected projections 53 detected or the time required for each detection, whereby a central processing unit (CPU) (not shown) provided for the body casing 2 judges the information of the developing cartridge 17. For example, if the detected projection 53 is detected by the sensor (not shown), the CPU (not shown) judges that this developing cartridge 17 is new.

Since the detection gear 46 is a gear with missing tooth as described above, the rotation of the detection gear 46 is stopped if the meshing of the gear teeth between the agitator gear 45 and the detection gear 46 is resolved. Therefore, when the developing cartridge 17 is remounted on the process casing 14, the detected projection 53 is not detected by the sensor (not shown) because the detection gear 46 is not rotated even if the agitator 45 is rotated. Accordingly, the CPU (not shown) judges that the developing cartridge 17 is not new.

In the developing cartridge 17, the supply roller gear 41 for driving the supply roller 15 is meshed with the input gear 40 into which a driving force from the outside is input, before the developing roller gear 43 for driving the developing roller 6. Therefore, if a driving force is input into the input gear 40 from the outside, the driving force is transmitted to the supply roller gear 41, before the developing roller gear 43. Since the supply roller gear 41 is meshed with the input gear 40 but the developing roller gear 43 is not meshed with the input gear 40, a greater driving force is transmitted to the supply roller gear 41 than in the case where both the supply roller gear 41 and the developing roller gear 43 are meshed with the input gear 40.

Consequently, at the beginning when the developing cartridge 17 is used as a new article, that is, in a case in which there is no developer at the nip 39 (see FIG. 1) between the developing roller 6 and the supply roller 15, and the supply roller 15 is subjected to a larger load, the supply roller 15 can start rotating before the developing roller 6.

If the input gear 40 is disposed in a central part (i.e., a central part in the up-down direction) of the developing cartridge 17, the distance from the portion of the developing cartridge 17 receiving an angular moment of the input gear 40 (the lower end portion on the side of the developing roller 6 and the upper end portion opposite to the end portion on the side of the developing roller 6 across the input gear 40) to the input gear 40 can be equalized, whereby it does not occur that strong force acts unevenly on any of the end portions (i.e., the lower end portion and upper end portion). If the input gear 40 is meshed with the supply roller gear 41 before the developing roller gear 43, the input gear 40 can be disposed near the central part of the developing cartridge 17. Further, if the input gear 40 is meshed with the supply roller gear 41 before the developing roller gear 43, the number of parts can be reduced because there is no need for the excess idle gear.

The portion around the partition wall 31 for partitioning the inside of the developing casing 30 into the first chamber 32 and the second chamber 33 has high rigidity in the developing casing 30, as shown in FIG. 1. Since the input gear 40 and the partition wall 31 overlap each other, the input gear 40 is supported at a portion of the developing casing 30 with high rigidity. Therefore, a driving force from the outside can be stably input into the input gear 40.

A driving force from the supply roller gear 41 can be transmitted to the developing roller gear 43 via the first idle gear 42 meshed with the supply roller gear 41 and the developing gear 43, as shown in FIG. 2B. Since the relative position between the supply roller gear 41 and the developing roller gear 43 can be arbitrarily changed by using the first idle gear 42, the degree of freedom in the design can be increased. Also, the supply roller 15 and the developing roller 6 can have the same rotational direction by using the first idle gear 42.

Since the supply roller gear 41 is meshed with the input gear 40 and the first idle gear 42, each of the tooth flank of the input gear 40 and the tooth flank of the first idle gear 42 presses the tooth flank of the supply roller gear 41, when the gears are driven. Thereby, the resultant force Z of the pressing force X of the tooth flank of the input gear 40 on the tooth flank of the supply roller gear 41 and the pressing force Y of the tooth flank of the first idle gear 42 on the tooth flank of the supply roller gear 41 acts on the reinforcing plate 55 that bears the supply roller 15, so that the reinforcing plate 55 tends to deviate in the action direction of the resultant force Z (see FIGS. 2B and 2C and FIG. 3). However, the contact part 59 (the input gear shaft 49 and the first idle gear shaft 50) provided in the developing casing 30 contacts the reinforcing plate 55 from the downstream side in the action direction of the resultant force Z (see FIG. 2C).

Consequently, the deviation of the reinforcing plate 55 is prevented, whereby the supply roller 15 borne by the reinforcing plate 55 can be rotated at the fixed position precisely. As the input gear 40 and the first idle gear 42 are rotated, even if a force in the opposite direction to the action direction of the resultant force Z acts on the input gear shaft 49 and the first idle gear shaft 50 (see FIG. 2C), the force in the opposite direction is canceled by the resultant force Z, whereby the deviation of the input gear shaft 49 and the first idle gear shaft 50 can be prevented. Consequently, the position of the input gear shaft 49, the first idle gear shaft 50 and the reinforcing plate 55 (supply roller 15) is stabilized.

Since the contact part 59 can serve as the input gear shaft 49 that supports the input gear 40 and the first idle gear shaft 50 that supports the first idle gear 42, the number of parts can be reduced (see FIG. 2C).

II. Modified Exemplary Embodiments

In the above-described exemplary embodiments, the process casing 14 and the developing cartridge 17 as shown in FIG. 1 are mounted or dismounted integrally as the process cartridge 13 on or from the body casing 2. Alternatively, the developing cartridge 17 may be mounted or dismounted on or from the body casing 2 in a state where process casing 14 is mounted on the body casing 2.

The above-described exemplary embodiments of the invention have been described in relation to a so-called direct transfer type color printer in which the developer image on the surface of each photosensitive drum 3 is directly transferred onto the sheet P. Alternatively, the invention may be applied to an intermediate transfer type color printer or a monochrome printer, for example, in which the developer image of each photosensitive drum 3 is once transferred onto an intermediate transfer body and then collectively transferred onto the sheet P.

In the above-described exemplary embodiments, the photosensitive drum 3 is exposed by the LED. In addition, the invention may be also applied to a laser printer in which the photosensitive drum 3 is exposed by laser.

According to the illustrative aspects of the invention, the supply roller gear which drives the supply roller is meshed with the input gear before the developing roller gear. Therefore, if an external driving force is input to the input gear, this driving force is transmitted to the supply roller gear before the developing roller gear. Since the supply roller gear is meshed with the input gear, but the developing roller gear is not meshed with the input gear, a greater driving force is transmitted to the supply roller gear than in the case where both the supply roller gear and the developing roller gear are meshed with the input gear.

Consequently, when the developing cartridge is initially used, i.e., a case in which there is no developer between the developing roller and the supply roller and a greater load is applied on the supply roller, the supply roller can more easily start rotating before the developing roller.

Moreover, the input gear may be disposed in the central part of the developing cartridge, such that a distance from the input gear to portions of the developing cartridge receiving the angular moment of the input gear (i.e., an end portion on the side of the developing roller and an end portion opposite to the end portion on the side of the developing roller across the input gear) can be equalized. Accordingly, a force applied to each end portion is approximately the same. In other words, a situation in which a stronger force acts unevenly on any one of the end portions does not occur. If the input gear is meshed with the supply roller gear before the developing roller gear, the input gear can be disposed near the central part of the developing cartridge. Further, if the input gear is meshed with the supply roller gear before the developing roller gear, the number of parts can be reduced because there is no need for the excess idle gear.

According to another aspect of the invention, in the developing cartridge, the developing roller gear is not directly meshed with the input gear but is engaged with the supply roller gear, and the supply roller gear is directly meshed with the input gear.

According to still another aspect of the invention, the developing cartridge further comprises: a housing comprising a partition wall that partitions an inside of the housing into a first chamber that accommodates the developer and a second chamber that houses the developing roller and the supply roller, wherein the input gear and the partition wall overlap each other as viewed from a side of the developing cartridge.

According thereto, the rigidity of the housing is higher around the partition wall for partitioning the inside of the housing into the first chamber and the second chamber. Since the input gear and the partition wall overlap each other when projected along the rotation axis of the developing roller, the input gear is supported at the portion of high rigidity in the housing. Therefore, the driving force from the outside can be stably inputted into the input gear.

According to still another aspect of the invention, the developing cartridge further comprises: an idle gear that is meshed with the supply roller gear and the developing roller gear and transmits the driving force from the supply roller gear to the developing roller gear.

According thereto, the driving force from the outside can be transmitted to the developing roller gear via the idle gear which is meshed with the supply roller gear and the developing roller gear, for transmitting the driving force from the supply roller gear to the developing roller gear. Also, since the relative position between the supply roller gear and the developing roller gear can be arbitrarily changed using the idle gear, the degree of freedom in the design can be enhanced. Also, the supply roller and the developing roller can have the same rotation direction by using the idle gear.

According to still another aspect of the invention, the developing cartridge further comprises: a reinforcing plate provided in the housing to bear the supply roller; and a contact part provided in the housing to make contact with the reinforcing plate from a downstream side in an action direction of a resultant force generated by the combination of a pressing force of a tooth flank of the input gear on the tooth flank of the supply roller gear and a reaction pressing force of the tooth flank of the idle gear on the tooth flank of the supply roller gear.

According thereto, the supply roller gear is meshed with the input gear and the idle gear, whereby if the gears are driven, each of the tooth flank of the input gear and the tooth flank of the idle gear presses the tooth flank of the supply roller gear. Thereby, the resultant force of the pressing force of the tooth flank of the input gear on the tooth flank of the supply roller gear and the pressing force of the tooth flank of the idle gear on the tooth flank of the supply roller gear acts on the reinforcing plate that bears the supply roller, so that the reinforcing plate tends to be deviated in the action direction of the resultant force. However, the contact part provided in the housing makes contact with the reinforcing plate from the downstream side in the action direction of the resultant force.

Consequently, the deviation of the reinforcing plate is prevented, making it possible to rotate the supply roller borne on the reinforcing plate at the fixed position precisely.

According to still another aspect of the invention, in the developing cartridge, the contact part comprises: an input gear shaft that supports the input gear; and an idle gear shaft that supports the idle gear.

According thereto, the contact part can serve as the shaft for supporting the input gear and the shaft for supporting the idle gear, whereby a number of parts can be reduced.

According to still another aspect of the invention, in the developing cartridge, the reinforcing plate comprises: a rectangular thin plate; a through hole provided at a center of the rectangular thin plate; a pawl that is provided on an upstream side of the rectangular thin plate in the action direction of the resultant force; and a recess provided in the rectangular thin plate for each of the input gear shaft and the idle gear shaft, wherein an end portion of the supply roller is supported in the through hole in the rectangular thin plate.

According to still another aspect of the invention, the developing cartridge further comprises: an idle gear that is meshed with the supply roller gear and the developing roller gear and transmits the driving force from the supply roller gear to the developing roller gear.

According to still another aspect of the invention, in the developing cartridge, gear teeth of the input gear and gear teeth of the supply roller gear are more tightly meshed together than gear teeth of the idle gear and the developing roller gear such that the supply roller is rotated before the developing roller when the external driving force is applied to the input gear.

According to still another aspect of the invention, in the developing cartridge, a force transmitted from the input gear to the supply roller is greater than a force transmitted from the input gear to the developing roller.

According to still another aspect of the invention, in the developing cartridge, gear teeth of the input gear and gear teeth of the supply roller gear are more tightly meshed together than gear teeth of the idle gear and the developing roller gear such that the supply roller is rotated before the developing roller when an external driving force is applied to the input gear.

What is claimed is:

1. A developing cartridge comprising:

an input gear which receives an external driving force;

a developing roller which carries developer;

a supply roller that is in contact with the developing roller and supplies the developer to the developing roller;

a supply roller gear that is meshed with the input gear to drive the supply roller using a driving force transmitted from the input gear;

a developing roller gear that drives the developing roller with a driving force transmitted from the supply roller gear;

a housing comprising a partition wall that partitions an inside of the housing into a first chamber that accommodates the developer and a second chamber that houses the developing roller and the supply roller;

an idle gear that is meshed with the supply roller gear and the developing roller gear and transmits the driving force from the supply roller gear to the developing roller gear;

a reinforcing plate provided in the housing to bear the supply roller; and a contact part provided in the housing to make contact with the reinforcing plate from a downstream side in an action direction of a resultant force generated by the combination of a pressing force of a tooth flank of the input gear on the tooth flank of the supply roller gear and a reaction pressing force of the tooth flank of the idle gear on the tooth flank of the supply roller gear, wherein the input gear and the partition wall overlap each other as viewed from a side of the developing cartridge.

2. The developing cartridge according to claim 1, wherein the developing roller gear is not directly meshed with the input gear but is engaged with the supply roller gear, and wherein the supply roller gear is directly meshed with the input gear.

3. The developing cartridge according to claim 1, wherein the contact part comprises:

an input gear shaft that supports the input gear; and an idle gear shaft that supports the idle gear.

4. The developing cartridge according to claim 3, wherein the reinforcing plate comprises:

a rectangular thin plate;

a through hole provided at a center of the rectangular thin plate;

a pawl that is provided on an upstream side of the rectangular thin plate in the action direction of the resultant force; and a recess provided in the rectangular thin plate for each of the input gear shaft and the idle gear shaft, wherein an end portion of the supply roller is supported in the through hole in the rectangular thin plate.

5. A developing comprising:

an input gear which receives an external driving force;

a developing roller which carries developer;

a supply roller that is in contact with the developing roller and supplies the developer to the developing roller;

a supply roller gear that is meshed with the input gear to drive the supply roller using a driving force transmitted from the input gear;

a developing roller gear that drives the developing roller with a driving force transmitted from the supply roller gear; and an idle gear that is meshed with the supply roller gear and the developing roller gear and transmits the driving force from the supply roller gear to the developing roller gear, wherein gear teeth of the input gear and gear teeth of the supply roller gear are more tightly meshed together than gear teeth of the idle gear and the developing roller gear such that the supply roller is rotated before the developing roller when the external driving force is applied to the input gear.

6. A developing cartridge comprising:

a housing comprising a partition wall which partitions an inside of the housing into a first chamber which accommodates a developer, and a second chamber, the partition wall being located centrally within the developing cartridge;

a developing roller that carries developer and which is provided in the second chamber of the housing;

a supply roller that is in contact with the developing roller and supplies the developer to the developing roller, the supply roller also being provided in the second chamber of the housing;

an input gear that is attached to a first cylindrical boss provided on an outside of the housing and positioned such that the input gear and the partition wall overlap;

a supply roller gear that is attached to a shaft of the supply roller, the supply roller gear being directly meshed with the input gear to receive a driving force transmitted from the input gear;

an idle gear that is attached to a second cylindrical boss provided on the outside of the housing, the idle gear being meshed with the supply roller gear;

a developing roller gear that is attached to a shaft of the developer roller and is meshed only to the idle gear to receive a driving force transmitted from the supply roller gear through the idle gear; and a reinforcing portion comprising a thin rectangular plate, a pawl which is attached to the housing, and a through hole which is provided in the thin rectangular plate and to which the shaft of the supply roller is rotatably attached, wherein adjacent corners of the thin rectangular plate are notched to mate with the first cylindrical boss and the second cylindrical boss, and an opposite side of the thin rectangular plate from the first and second cylindrical bosses is notched to accommodate the pawl, in order to stabilize the supply roller while the supply roller is driven by the input gear.

7. The developing cartridge according to claim 6, wherein a force transmitted from the input gear to the supply roller is greater than a force transmitted from the input gear to the developing roller.

8. The developing cartridge according to claim 6, wherein gear teeth of the input gear and gear teeth of the supply roller gear are more tightly meshed together than gear teeth of the idle gear and the developing roller gear such that the supply roller is rotated before the developing roller when an external driving force is applied to the input gear.

* * * * *